US010783749B2

(12) United States Patent
deWaal

(10) Patent No.: US 10,783,749 B2
(45) **Date of Patent: *Sep. 22, 2020**

(54) SYSTEM AND METHOD FOR PROVIDING A SECONDARY CONTEST DEPENDENT ON THE RESULTS OF A PRIMARY GAME

(71) Applicant: Daniel Jacobus deWaal, Reno, NV (US)

(72) Inventor: Daniel Jacobus deWaal, Reno, NV (US)

(73) Assignee: deWaalIP LLC, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/507,175

(22) Filed: Jul. 10, 2019

(65) Prior Publication Data

US 2019/0333335 A1 Oct. 31, 2019

Related U.S. Application Data

(63) Continuation of application No. 15/449,491, filed on Mar. 3, 2017, now Pat. No. 10,417,871, which is a continuation of application No. 14/994,072, filed on Jan. 12, 2016, now Pat. No. 9,626,835, which is a continuation-in-part of application No. 14/076,088, filed on Nov. 8, 2013, now Pat. No. 9,269,232.

(60) Provisional application No. 61/724,941, filed on Nov. 10, 2012.

(51) Int. Cl.
*G07F 17/32* (2006.01)

(52) U.S. Cl.
CPC ..... *G07F 17/3267* (2013.01); *G07F 17/3227* (2013.01); *G07F 17/3239* (2013.01); *G07F 17/3244* (2013.01); *G07F 17/3258* (2013.01); *G07F 17/3276* (2013.01); *G07F 17/3293* (2013.01)

(58) Field of Classification Search
CPC ..... G07F 17/32
See application file for complete search history.

(56) References Cited

U.S. PATENT DOCUMENTS

| | | | |
|---|---|---|---|
| 5,511,781 | A | 4/1996 | Wood et al. |
| 6,019,374 | A | 2/2000 | Breeding |
| 6,279,910 | B1 | 8/2001 | de Keller |
| 6,283,474 | B1 | 9/2001 | de Keller |
| 6,719,291 | B1 | 4/2004 | deKeller |
| 8,439,362 | B1 | 5/2013 | deKeller |
| 9,165,431 | B2 | 10/2015 | Chun |
| 2002/0039923 | A1 | 4/2002 | Cannon et al. |
| 2004/0132519 | A1 | 7/2004 | Holm |

(Continued)

OTHER PUBLICATIONS

Aquarius Productions Ltd 2000, SKiNS Blackjack, 2 pages.
Aquarius Productions 2002-2006, Skins Blackjack with Bad Beat Progressive Jackpot, 1 page.

*Primary Examiner* — Omkar A Deodhar

(74) *Attorney, Agent, or Firm* — Howard & Howard Attorneys PLLC

(57) ABSTRACT

Systems and methods for providing a secondary contest involving a plurality of players playing a primary award wagering game. The players enter wagers in the primary game, and the results from the primary wagering game determine the outcome of a secondary pari-mutuel contest in which players compete against each other. The results from the primary wagering game resolve the secondary contest where the highest ranking results will win the wagers placed in the secondary contest on a tiered basis.

20 Claims, 16 Drawing Sheets

(56) References Cited

U.S. PATENT DOCUMENTS

| | | | |
|---|---|---|---|
| 2008/0108429 | A1 | 5/2008 | Davis et al. |
| 2010/0004051 | A1 | 1/2010 | Walker et al. |
| 2010/0006914 | A1 | 3/2010 | Velu et al. |
| 2011/0115158 | A1 | 5/2011 | Gagner et al. |
| 2014/0135094 | A1 | 5/2014 | deWaal |
| 2014/0291932 | A1 | 10/2014 | Castle, II et al. |

SYSTEM AND METHOD FOR PROVIDING A SECONDARY CONTEST DEPENDENT ON THE RESULTS OF A PRIMARY GAME

CROSS-REFERENCE TO RELATED APPLICATION

This application is a continuation of U.S. patent application Ser. No. 15/449,491, filed Mar. 3, 2017, which is a continuation of U.S. patent application Ser. No. 14/994,072, filed Jan. 12, 2016 (now U.S. Pat. No. 9,626,835, issued Apr. 18, 2017), which claims priority to U.S. patent application Ser. No. 14/076,088, filed Nov. 8, 2013 (now U.S. Pat. No. 9,269,232, issued Feb. 23, 2016) and U.S. Provisional Patent Application Ser. No. 61/724,941, filed Nov. 10, 2012, the disclosures of which are hereby incorporated by reference in their entirety for all purposes.

COPYRIGHT NOTICE

The figures included herein contain material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

BACKGROUND ART

The subject matter disclosed herein relates generally to systems and methods for facilitating game play, and in particular, wagering game play.

New wagering opportunities are always of interest to players and operators alike to make games more appealing and generate greater interest and game play. In some gaming jurisdictions particular types of wagering games are not permitted. In some instances, creating secondary contests where players share in pari-mutuel prize pools and do not receive awards from the primary wagering game are a way to offer legitimate play of such wagering games that would otherwise be prohibited. It should also be understood that for certain games, a critical mass of participant players is required while for others only set numbers of players are permitted. In many instances the secondary contests occur on Portable Network Connected Devices ("PNCDs") such as cell phones or tablet computers that are connected to the primary wagering game through a network. The invention is directed to satisfying these needs.

SUMMARY OF THE INVENTION

The invention is generally directed to systems and methods for using game play information generated by a first game involving players playing against a house, to determine the outcome of a second game involving different groups of players competing against one another.

Some embodiments of the invention are directed to methods and systems for providing a secondary contest involving a plurality of players, each player playing a primary wagering game at a live dealer table where live gaming activities such as wagers placed, and game results such as cards dealt or dice rolls are interpolated by computing devices such as RFID chip readers, laser chip trays, chipping machines, optic or other sensors and "Smart Shoes," and are communicated to an eligible gaming device within a communication network. Players using eligible computing devices are provided secondary game communications which provide for or involve the steps of: displaying a query to each player of the primary game through a display device on each of the eligible computing devices within the communication network, wherein the query notifies the player of a preset time period for entering a wager in a secondary contest; receiving a secondary contest wager from one or more players during the preset time period; adding those secondary wagers to a game specific pari-mutuel pool; interpolating the actuating of an instance of the primary game upon the expiration of the preset time period for the one or more secondary contest players; comparing the resulting outcome of the primary game for each secondary contest player, wherein each of the resulting outcomes is associated with a number of credits or chips won; awarding at least a portion of the wagers placed in the secondary contest to the winning secondary contest players identified based on the number of credits or chips won in the primary game. It should be understood, that for purposes of this description including the claims and the figures, the term "interpolate" or any form of the word is interchangeable with the term "interpret" or its variations.

Some embodiments of the invention are directed to methods and systems for providing a secondary contest involving a plurality of players, each player playing a primary wagering game on an eligible computing device within a communication network, which provide for or involve the steps of: displaying a query to each player of the primary game through a display device on each of the eligible computing devices within the communication network, wherein the query notifies the player of a preset time period for entering a wager in a secondary contest; receiving a secondary contest wager from one or more players during the preset time period; actuating an instance of the primary game upon the expiration of the preset time period for the one or more secondary contest players; comparing the resulting outcome of the primary game for each secondary contest player, wherein each of the resulting outcomes is associated with a rank; determining an outcome of the instance of the secondary contest, wherein the outcome includes at least one of an identification of a winning secondary contest player, wherein the winning secondary contest player is the player having the resulting outcome of the highest rank, and an identification of a tie outcome, wherein the tie outcome includes two or more players having a resulting outcome of the highest rank; responsive to the identification of a winning secondary contest player, awarding at least a portion of the wagers placed in the secondary contest to the winning secondary contest player identified; and responsive to the identification of a tie, repeating some or all of the aforementioned steps.

Some embodiments of the invention are directed to a method for providing a secondary contest including a plurality of players involved in the play of a primary wagering game on one or more computing devices, each computing device including a display device and communication interface enabling communication within a network including other computing devices and a secondary contest controller, the method comprising the steps of: displaying a secondary contest notification on the display device of each computing device in the network prior to the actuation of an instance of the primary wagering game, wherein the secondary contest notification provides information relating to an opportunity to enter a wager in a secondary contest through the communication interface; receiving data relating to the entry of a secondary contest wager identifying the computing device from which the data is received; receiving outcome data relating to a subsequent instance of the primary wagering game actuated at each computing device of the identified eligible computing devices, wherein the outcome data includes a randomly generated result in the primary wagering game for each identified eligible computing device; comparing the randomly generated result for each identified eligible computing device with a preset criteria for determining an outcome of the secondary wagering contest, wherein the outcome is a winning, partial winning or a non-winning outcome for one or more identified eligible computing devices; responsive to the satisfaction of the preset criteria for a winning or partial winning outcome, displaying an award notification on the display device of the one or more identified eligible computing devices satisfying the preset criteria for the winning outcome of an awarding of at least a portion of the secondary contest wagers received; and responsive to the satisfaction of the preset criteria for a non-winning outcome, repeating some or all of the aforementioned steps for the one or more identified eligible computing devices satisfying the preset criteria for the non-winning outcome.

In some embodiments, the notification further identifies an amount of time remaining for receiving data relating to the entry of a wager in the secondary contest, and the data relating to the entry of a secondary contest wager may only be received during the amount of time remaining.

In some embodiments, the randomly generated result comprises an amount of credits or chips won. Alternatively, the randomly generated result comprises cards that are dealt a poker ranking or roll of the dice value.

The preset criteria for determining a winning or partial winning outcome of the secondary wagering contest may be the randomly generated result associated with cards that are dealt, a roll of the dice or the highest poker rank. In other embodiments, the preset criteria for determining a winning or partial winning outcome of the secondary wagering contest is the randomly generated result associated with the number of credits or chips won, or a threshold amount of credits or chips. The preset criteria for determining a non-winning outcome of the secondary wagering contest may be the failure of the outcome data to satisfy the preset criteria for a winning or partial winning outcome.

In some embodiments, the aforementioned method further comprises the step of actuating the primary wagering game on each identified eligible computing device.

Some embodiments of the invention are directed to a system comprising: a computing device including a display device and communication interface enabling communication within a network including other computing devices and a secondary contest controller, wherein the computing device is operatively associated with a processor for facilitating play of a primary wagering game; the secondary contest controller facilitating the displaying of a secondary contest notification on the display device of each computing device in the network prior to the actuation of an instance of the primary wagering game, wherein the secondary contest notification provides information relating to an opportunity to enter a wager in a secondary contest through the communication interface, wherein the controller includes a communication interface and a processor for: receiving data relating to the entry of a secondary contest wager identifying the computing device from which the data is received; receiving outcome data relating to a subsequent instance of the primary wagering game actuated at each computing device of the identified eligible computing devices, wherein the outcome data includes a randomly generated result in the primary wagering game for each identified eligible computing device; comparing the randomly generated result for each identified eligible computing device with a preset criteria for determining an outcome of the secondary wagering contest, wherein the outcome is one of a winning outcome or a non-winning outcome for one or more identified eligible computing devices; responsive to the satisfaction of the preset criteria for a winning or partial winning outcome, displaying an award notification on the display device of the one or more identified eligible computing devices satisfying the preset criteria for the winning outcome of an awarding of at least a portion of the secondary contest wagers received; and responsive to the satisfaction of the preset criteria for a non-winning outcome, retrieving one or more subsequent instances of the primary wagering game actuated at each computing device of the identified eligible computing devices for comparison with the preset criteria. In some embodiments, the computing device is an electronic gaming machine. The computing device may be operatively associated with the processor of the controller.

Some embodiments of the invention are directed to a method for providing a secondary contest operated by a secondary contest controller to include a plurality of players involved in the play of a primary wagering game on one or more computing devices, each computing device including a display device and communication interface, the method comprising the steps of: a) transmitting content for display on the display device of each computing device in the network prior to the actuation of an instance of the primary wagering game, wherein the content includes a secondary contest notification relating to an opportunity to enter a wager in a secondary contest through the computing device; b) receiving data relating to the entry of a secondary contest wager identifying the computing device from which the data is received; c) retrieving outcome data relating to a subsequent instance of the primary wagering game actuated at each computing device of the identified eligible computing devices, wherein the outcome data includes a randomly generated result in the primary wagering game for each identified eligible computing device; d) comparing the randomly generated result for each identified eligible computing device with a preset criteria for determining an outcome of the secondary wagering contest, wherein the outcome is one of a winning, partial winning or a non-winning outcome for one or more identified eligible computing devices; e) responsive to the satisfaction of the preset criteria for a winning or partial winning outcome, transmitting content for display on the display device of the one or more identified eligible computing devices satisfying the preset criteria for the winning outcome including information relating to an awarding of at least a portion of the secondary contest wagers received; and f) responsive to the satisfaction of the preset criteria for a non-winning outcome, repeating steps c) through f) for the one or more identified eligible computing devices satisfying the preset criteria for the non-winning outcome.

Some embodiments of the invention are directed to methods and systems for providing a secondary contest involving a plurality of players, each player playing a primary wagering game in which a live dealer emulates a primary gaming controller and some aspects of a secondary game controller using an input device to capture primary game activities such as wagers placed, cards dealt, rolls of the dice, poker rankings and credits or chips won into one or more computing devices. A display associated with the secondary game controller notifies players of a preset time period for entering a wager in a secondary contest; using a data input device the dealer enters data related to receiving a secondary contest wager from one or more players during the preset time period into one or more computers, The secondary game controller adding those secondary wagers to a game specific pari-mutuel pool; the dealer actuating an instance of the primary game upon the expiration of the preset time period for the one or more secondary contest players; the secondary game controller comparing the resulting outcome of the primary game for each secondary contest player, wherein each of the resulting outcomes is associated with cards dealt, a roll of the dice, a poker ranking or a number of chips won and awarding participant players portions of the pari-mutuel pool based on winning or partial winning outcomes by printing payment "Chits" that can be redeemed for cash, these "Chits" are then distributed by the dealer.

BRIEF DESCRIPTION OF THE DRAWINGS

Other advantages of the invention will be readily appreciated as the same becomes better understood by reference to the following detailed description when considered in connection with the accompanying drawings wherein.

DETAILED DESCRIPTION OF THE PREFERRED EMBODIMENT

The exemplary embodiments herein relate to various systems and methods used in gaming applications. It should be understood that each of the methods and individual steps recited herein may be partially or wholly carried out in a variety of ways and/or systems, which may include, but are not limited to, an electronic gaming machine ("EGM") for use by one or more players, a multiplayer platform which may include a player interface such as a touchscreen display and involve physical or virtual game symbols, a home computer and/or portable computing device, such as a tablet computer or mobile phone capable of communicating with a network or over the Internet, global telecommunication network or world wide web.

It should further be understood that the invention is directed to, among other things, methods of providing, conducting and resolving wagering games that include a sequence of controlled and concrete transformative events. Some of these events may involve communications between computing components, establishing the eligibility of such computing components based on location and game specific rules, indication preferences, placing wagers, debiting and awarding credits stored in an account, the generation or interpretation of random data and results for one or more players, the application of randomly-generated data to predefined rules, the ranking of results relative to all players in a game, the pooling of all wagers placed, the determination of wager outcomes in accordance with preset outcome determining criteria, and the notification of such outcomes along with the designation of a portion of the wager pool as a commission for the operator or game provider. The generation of random data may be facilitated by computerized and/or physical implements, such as a random number generator ("RNG") or a cards dealt, a roll of the dice or credits/chips awarded. The transformative events may also include parsing of the data for comparative purposes with preset criteria to determine an outcome in a second, bonus or associated wagering game.

A selected embodiment of the invention will now be explained with reference to the drawings. It will be apparent to those skilled in the art from this disclosure that the following description of the embodiment of the invention is provided for illustration only and not for the purpose of limiting the invention as defined by the appended claims and their equivalents.

Figure 1:
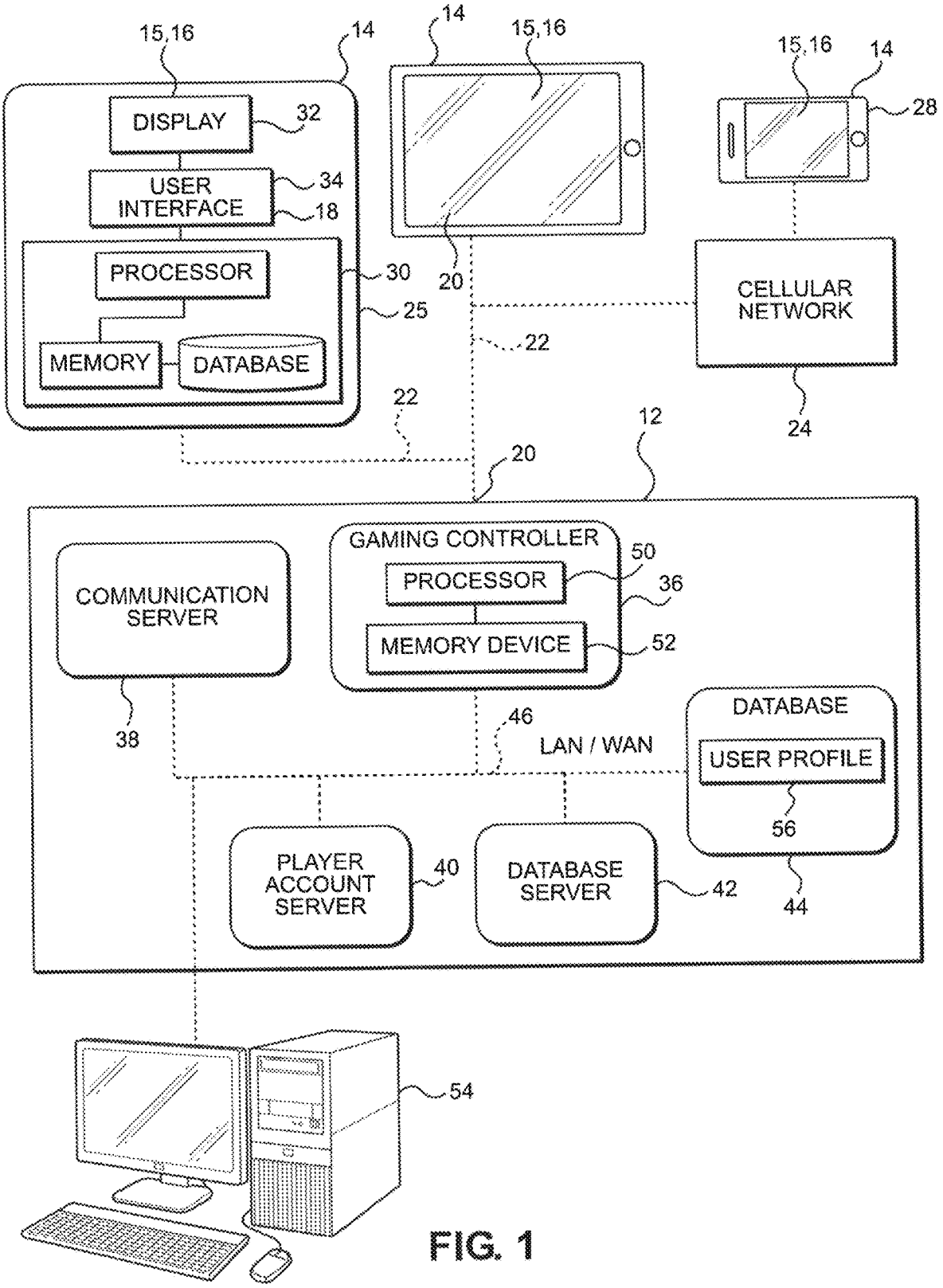
FIG. 1 is a schematic representation of an exemplary system for allowing a player to play a primary game and a secondary contest via a user computing device, according to an embodiment of the invention.
Figure 2:
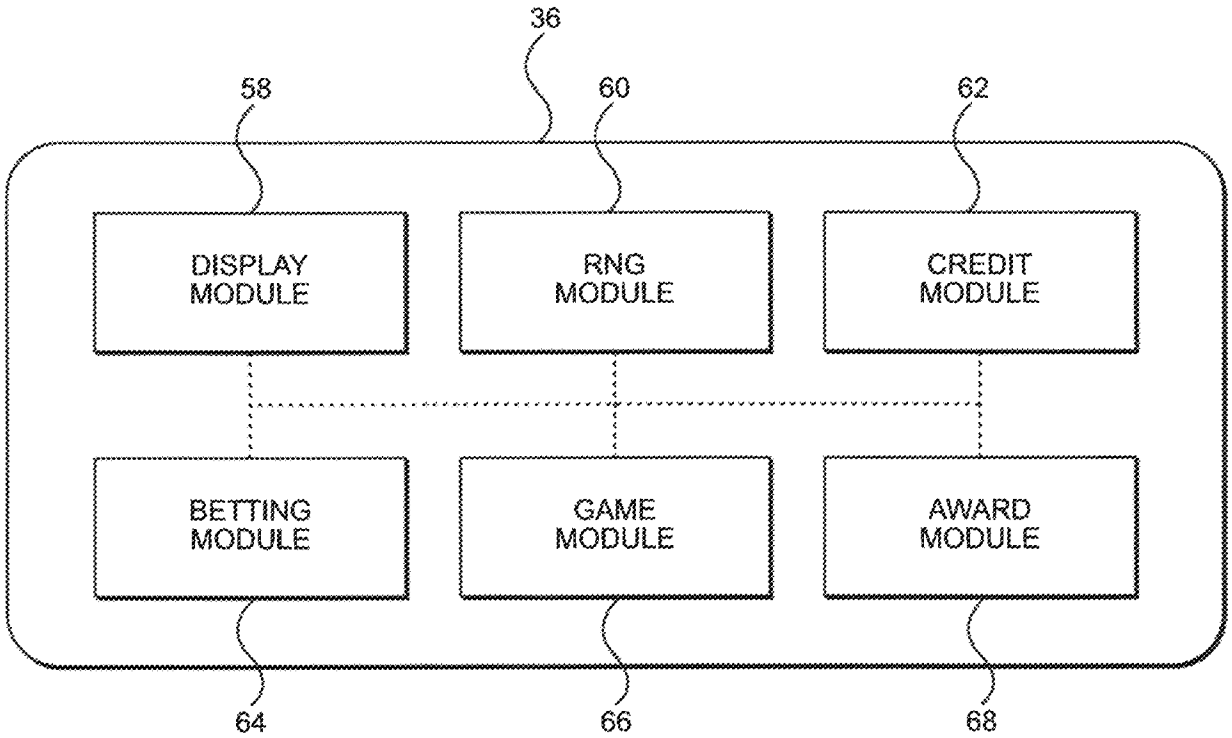
FIG. 2 is schematic view of a gaming controller that may be used with the system shown in FIG. 1.

FIG. 1 is a schematic representation of the system 10, according to an embodiment of the invention. In the illustrated embodiment, the system 10 includes a server system 12 that is coupled to one or more user computing devices 14. Each user computing device 14 is configured to transmit and receive data to and/or from the server system 12 to display a primary game 15 and graphical interfaces 18 (such as those shown in FIGS. 4-14) to enable a user to participate in both instances of the primary game 15, which may involve the player competing against a paytable in a game operated by a processing device, such as for example, a draw poker game, and instances of a secondary contest 16 in which the result in the primary game is compared with a preset criteria to determine a winning or non-winning outcome. For example, the preset criteria may be the result in one or more instances of the primary game, such as a poker rank achieved, credits won over one or more games, game score, the appearance of symbols or patterns, achieving certain hands, such as losing hands, consecutive losing outcomes or hands, consecutive winning outcomes or hands, reaching a threshold after tracking players such as on a leader board, reaching a threshold based on credits earned or games played, such as a prize zone, which is then used to compare against similar results from other players playing the primary game on their own computing device 14. The status of the player relative to reaching a threshold may be visualized on a display screen in any manner, such as a rising bar on a bar graph or a needle on a dial completing a circle, for example.

In some embodiments, the reaching of a threshold, based on a score, credits earned or games played for example, will entitle the player having reached the threshold to entrance into one or more prize zones, wherein each prize zone may be associated with an additional bonus prize awarded to the player. In some embodiments, reaching certain thresholds for prize zones or other awards may be based on and achieved by more than one player involved in the secondary contest 16, such as all or a portion of the players in the secondary contest 16 having played in a certain amount of games, achieving a score which is the sum of their combined scores, credits, poker ranks or winning hands or other results taken from the primary wagering game 15. The players' scores relative to the threshold may be tracked on a leader board which may be displayed on a display device associated with the computing device 14 or an independent display device. In some embodiments, the opportunity to reach thresholds may be reset upon the occurrence of certain events, such as reaching a particular threshold for a prize or should a player fail to enter the secondary contest 16. Alternatively, the scores or points added due to the departing player from the secondary contest 16 may be deducted from the remaining players cumulative score applied towards reaching a threshold.

In the illustrated embodiment, the server system 12 is coupled to each user computing device 14 via a communications link 20 that enables each user computing device 14 to access server system 12 over a network 22 such as, for example, a local network, the Internet, a cellular telecommunications network 24, a wireless network and/or any suitable telecommunication network that enables the user computing devices 14 to access the server system 12. For example, in one embodiment, user computing devices 14 may include a gaming machine 25, a mobile computing device 26 and a smartphone 28. Computing device 14 may communicate with server system 12 via a local network, while mobile computing device 26 and smartphone 28 communicate with the server system 12 via the cellular telecommunications network 24 and/or the Internet, for purposes of facilitating play of the primary game 15 and/or one or more instances of the secondary contest 16 among a wide range of players at the same time. In another embodiment, the user computing device 14 may include a personal computer, laptop, cell phone, tablet computer, smartphone/tablet computer hybrid, personal data assistant, and/or any suitable computing device that enables a user to connect to or communicate with the server system 12 and display the graphical interfaces 18 for purposes of facilitating instances of the secondary contest 16 while players may also be engaging in play of a primary wagering game 15 apart from the secondary contest 16.

In the illustrated embodiment, each user computing device 14 generally includes a controller 30 that is coupled to a display device 32 and a user input device 34. The controller 30 may include a processor, memory and database. Controller 30 receives and transmits information to and from the server system 12 for enabling the display and interaction between a player during play of a primary game 15, as well as facilitating the play of the secondary contest 16, and the graphical interfaces 18 (shown in FIGS. 4-14) on the display device 32 to enable the user to interact with the server system 12 to enter into and play the secondary contest 16 in accordance with the embodiments described herein. Controller 30 may include a random number generator for generating random results in instances of the primary wagering game 15.

The display device 32 may include and consist of, without limitation, a flat panel display, such as a cathode ray tube display (CRT), a liquid crystal display (LCD), a light-emitting diode display (LED), active-matrix organic light-emitting diode (AMOLED), a plasma display, and/or any suitable visual output device capable of displaying graphical data and/or text to a user. Moreover, the user input device 34 may include and consist of, without limitation, a keyboard, a keypad, a touch-sensitive screen, a scroll wheel, a pointing device, a barcode reader, a magnetic card reader, a radio frequency identification (RFID) card reader, an audio input device employing speech-recognition software, and/or any suitable device that enables a user to input data, such as making selections and placing wagers, into the controller 30 and/or to retrieve data from the controller 30. Alternatively, a single component, such as a touch screen, a capacitive touch screen, and/or a touchless screen, may function as both the display device 32 and as the user input device 34.

In the illustrated embodiment, the server system 12 includes a gaming controller 36, a communications server 38, a player account server 40, a database server 42 and a database 44. The servers 38, 40, and 42, gaming controller 36, and database 44 are connected through a network 46 such as, for example, a local area network (LAN), a wide area network (WAN), dial-in-connections, cable modems, wireless modems, and/or special high-speed Integrated Services Digital Network (ISDN) lines. Moreover, at least one administrator workstation 48 may also be connected to the network 46 to enable communication with the server system 12. The communications server 38 communicates with the user computing devices 14 and the administrator workstation 48 to facilitate transmitting data over the network 22 via a private network, the Internet and/or the cellular network 24, respectively.

The database server 42 is connected to the database 44 to facilitate transmitting data to and from the database 44. The database 44 contains information relating to a variety of matters, such as, for example, account information related to a user, user profile information, a primary game type, a number of game symbols such as card representations associated with a game, a number of game outcomes, a payout value associated with each game outcome, wagers, wager amounts, wager types, average wagers per game or contest, and image data for producing game or contest images and/or screens on the user computing device 14 and temporarily stores variables, parameters, and the like that are used by the gaming controller 36 for enabling play of a secondary contest 16. In one embodiment, the database 44 includes a centralized database that is stored on the server system 12 and is accessed directly via the user computing devices 14. In an alternative embodiment, the database 44 is stored remotely from the server system 12 and may be non-centralized.

The gaming controller 36 includes a processor 50 and a memory device 52 that is coupled to the processor 50. The memory device 52 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the processor 50 to store, retrieve, and/or execute instructions and/or data. Controller 36 may be further connected to a computer system 54 for administrative and backend support, among other things.

The processor 50 executes various programs, and thereby controls other components of the server system 12 and the user computing device 14 according to user instructions and data received from the user computing devices 14. The processor 50 in particular displays some or all of the graphical interfaces 18 (shown in FIGS. 4-14), may operate the primary game 15, but is involved in executing a secondary contest program, and thereby enables the system 10 to generate instances of the secondary contest 16 along with the primary game 15. For example, the system 10 may be enabled to query users of each computing device 14 while playing the primary game 15 as to whether they would like to enter into an instance of the secondary contest 16, and thereafter allow users or players to enter wagers in an instance of the secondary contest 16, and apply the outcome data of the primary game 15, which may include randomly generated results, to the outcome data in the primary games 15 of other players also competing in the same instance of the secondary contest 16, to determine a winner of the instance of the secondary contest based on a comparison of the respective outcome data of all players involved with a preset criteria for winning. In some embodiments, if the preset criteria for winning is not satisfied, then the outcome of the secondary contest 16 is non-winning, which may include a tie occurrence between one or more players, and the players will be automatically entered into a subsequent instance of the primary wagering game. The computing device 14 from which the results that satisfied the preset criteria for winning were received may receive a notification of the winning outcome in the secondary contest 16.

The memory device 52 stores programs and information used by the processor 50. Moreover, the memory device 52 stores and retrieves information in the database 44 including, but not limited to, image data for producing images and/or screens on the display device 32, and temporarily stores variables, parameters, and the like that are used by the processor 50.

In the illustrated embodiment, the gaming controller 36 is configured for actuating and administering multiple instances of the secondary contest 16 on computing devices 14. Instances of the secondary contest 16 may be actuated periodically or at preset timing intervals, such that players may be offered the opportunity to enter into the secondary contest after each outcome of the primary game 15 and before beginning a new instance of the primary game. Each user of a computing device 14 may be queried through display device 32 as to whether they would like to enter into one or more of the currently available instances of the secondary contests. Entry into an instance of the secondary contest may be accomplished by receiving or detecting a player selection to place a wager in response to the query displayed on display device 32 in a currently available instance of the secondary contest through input device 34. In some embodiments, instances of the secondary contest 16 are made available to users of the computing devices 14 for a limited period of time prior to actuating an instance of the primary game 15, which may be enabled by controller 30, and then a new instance of the secondary contest 16 is made available after the period of time has ended or after the primary game 15 is completed. In some embodiments, the query and time periods are uniformly provided throughout all computing devices 14 connected with network 22. Thus, any players entering into the secondary contest 16 during the same time period from any computing device 14 connected through network 22 would be entered into the same instance of the secondary contest 16. Alternatively, gaming controller 36 may enable players to play in the same or different instances of secondary contests through the user computing devices 14. In some embodiments, once it is detected that a player wishes to enter into a secondary contest 16, such as by placing a secondary contest wager, the instance of the secondary contest in which the player will be entered is dependent on the point in time upon which the outcome in the primary game 15 is determined.

In some embodiments, the player account server 40 stores information associated with a plurality of user profile accounts and a plurality of corresponding unique user identifiers in a user profile program 56 in the database 44 in order to facilitate player identity and play of the secondary contest 16. Each user profile account may also include financial account information associated with each user. The financial account information may include information relating to an amount of game credits available for use in playing games and/or any suitable financial information that enables the system 10 to function as described herein.

In the embodiment discussed herein, gaming controller 36 further includes or is in communication with a display module 58, a random-number generator (RNG) module 60, a credit module 62, a betting module 64, a game module 66, and an award module 68, for providing instances of a primary wagering game 15, particularly with regard to computing devices 14 other than electronic gaming machines that use controller 30, such as thin client platforms or mobile platforms for example. Thus, system 10 is capable of extending the primary game 15 and the secondary contest 16 to larger groups of players, among other things.

The display module 58 controls the display device 32 to display various images on the graphical interface 18 preferably by using computer graphics and/or image data stored in the database 44. More specifically, the display module 58 controls the symbols being displayed in a primary wagering game or secondary contest 16, such as for example, virtual representations of playing cards on the display device 32 or another display device by using computer graphics and/or the image data. In one embodiment, the display module 58 is configured to display a query or statement inviting a user of a computing device 14 to enter into an instance of a secondary contest 16 within a preset period of time. For example, the display module 58 may display the primary game including a game display area 70 and a statement or query 72 notifying players of the opportunity to place a wager in a secondary contest 16 within a time period, including a timer counting down the remaining time available for a player to place a wager to be involved in the secondary contest. Gaming controller 36 may also provide additional statements and progress updates on display device 32 or another display device as the countdown to entry continues and the instance of the secondary contest 16 develops. Player outcome data in the primary game for players involved in the secondary contest 16 may be displayed on the display device 32 or other display device for all players to see. In other words, as game controller 36 receives outcome data through randomly generated results and/or player decisions in the primary game 15 for each player involved in secondary contest 16, this information may be communicated to all players involved in secondary contest 16.

The credit module 62 communicates with the player account server 40 to manage the amount of player's credits available for use in playing the secondary contest 16. The credit module 62 receives a user selection indicative of a request from a user computing device 14 to place wagers in the secondary contest 16, including an amount of game credits associated with each wager, if appropriate, and deliver credits to the computing device 14 of the player having won an instance of the secondary contest 16.

The game module 66 includes a game program for use in playing the secondary contest 16 based on user selection input receive from a user computing device 14. The game module 66 receives game information in the primary game 15 and performs various functions and calculations to play the secondary contest 16. Game module 66 compares the game outcome data received in the primary game 15, such as the final hand rank in the primary game, with the final hand rank achieved by any other players in the secondary contest 16 to determine a winning hand.

In some embodiments, the game module may also provide a primary game 15 on a computing device 14, particularly with regard to the computing devices 14 other than electronic gaming machines that use controller 30 to provide the primary wagering game. Alternatively, another random number generator or game module may be used. For these types of computing devices 14, the game module 66 retrieves game elements from the database 44 and causes the display module 58 to display the primary game 15 on the display device 32. The game module 66 receives signals indicative of user selection input via the user input device 34 and generates an outcome of the primary game 15 based on the predetermined game rules and the received user selection input, and displays the game outcome on the display device 32. In such embodiments, a RNG module 60 generates and outputs random numbers to the game module 66 for use in playing the primary game 15. In addition, the game module 66 may use random numbers generated by the RNG module 60 to determine if a winning condition has occurred in the outcome of the primary game 15, and to determine whether or not to provide an award to a player. For example, if the game is the poker-type game 16, the game module 66 uses the RNG module 60 to randomly select one or more virtual representations of playing cards. The game module 66 compares the randomly selected cards with a paytable to determine the payout amount, if any, in the instance of the primary game 15.

It should be understood that the game outcome data may include any information relating to the wager determining result for the primary game 15, such as for example, the final hand condition or rank in a poker game, the numerical score of a blackjack or hand in a baccarat game, dice roll result in craps, roulette result determined by the ball, etc., which would be used for comparative purposes in the secondary contest 16. In other embodiments, the primary game 15 may be a slot game and the game outcome data for determining the outcome of the wager in the secondary contest 16 may be based on the results of one or more slot games, such as the amount won. In some embodiments, a leaderboard may be used to track results of the primary game 15 for comparative purposes in a secondary contest 16 relative to the scores of other players.

In the illustrated embodiment, the betting module 64 receives a user selection input from the input device 34 indicative of a wager being placed by the player on an instance of the secondary contest 16 and may display a notification indicative of the player's selection on the graphical interface 18. In addition, the betting module 64 transmits the player's selection to the game module 66 so that module 66 may apply the game outcome data from the subsequent instance of the primary game 15 in the instance of the secondary contest 16, particularly for any computing devices 14 that rely on module 66 for providing the primary wagering game 15. Betting module 64 may also store each wager associated with the primary game 15 and secondary contest 16. In some embodiments, players are permitted to buy into further rounds of the secondary game 16.

Each instance of the primary game 15 is generally played in a conventional manner. In the illustrated embodiment, the game module 66 determines an outcome of the instance of the primary game 15 for any computing device 14 relying on module 66 and an outcome for the instance of the secondary game 16 for all computing devices 14. The award module 68 awards a payout in the primary game 15 for any computing device 14 relying on module 66 and a payout in the secondary contest 16, if appropriate. The payout in the secondary contest 16 may be a portion or all of a pool of all wagers received in instance of the secondary contest 16. A commission for the operator may be subtracted from the pool of wagers upon payout of the wagers in any instance of the secondary contest 16.

Should game module 66 determine a tie outcome has occurred in the instance of the secondary contest 16, system 10 may automatically enter or offer entry to a new instance of the secondary contest 16 to the players having the tying game outcome data, which may or may not require receipt of an additional secondary contest wager and/or primary game wager from the computing device 14 associated with the tying players. Alternatively, the wagers received in the secondary contest may be divided amongst the players having the highest ranked tying hands.

In some embodiments, a qualifying criteria must be met in order to win the secondary contest 16. If the qualifying criteria is not satisfied, the players involved in the instance of the secondary contest 16 may be automatically entered or offered entry to a new instance of the secondary contest 16, which may or may not require receipt of an additional secondary contest wager and/or primary game wager. In some embodiments, the qualifying criteria relates to the outcome data, such as achieving a hand rank of at least a preset poker ranking.

Figure 3:
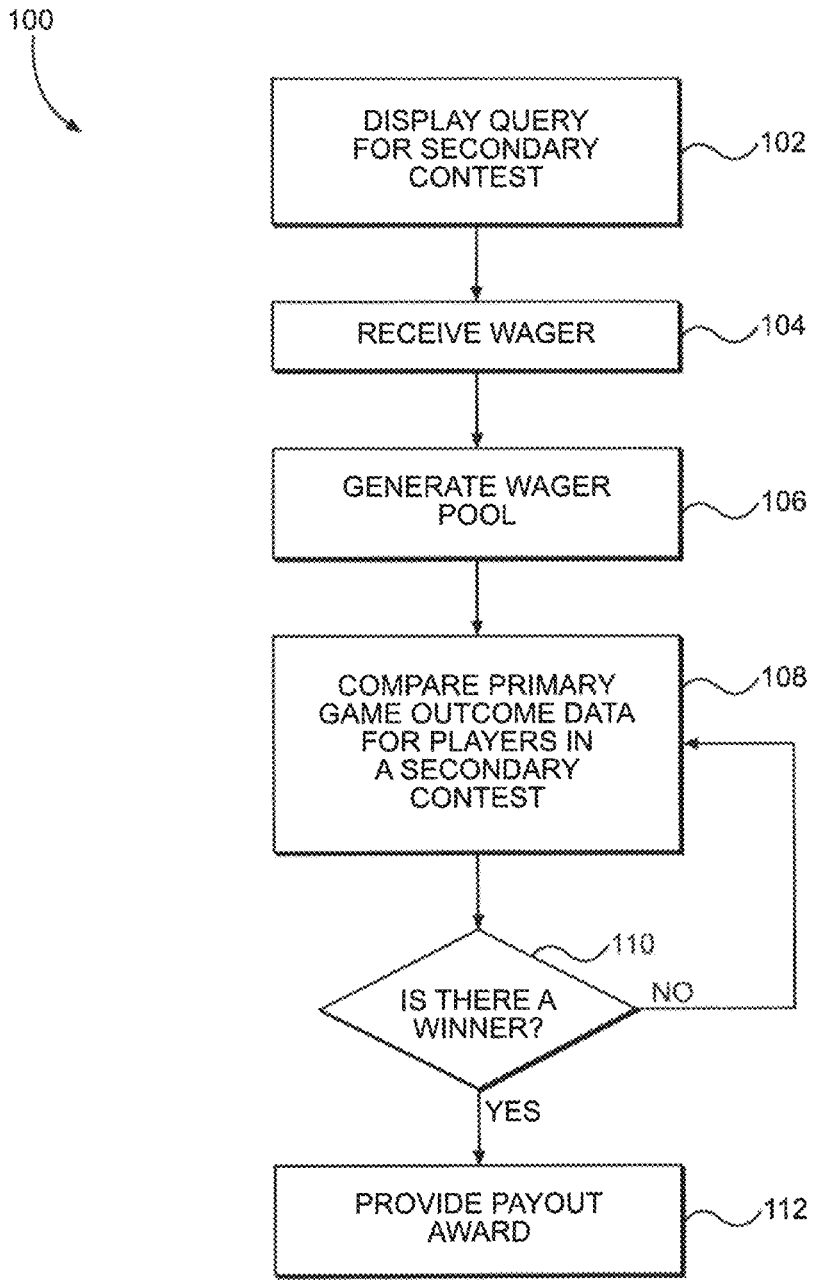
FIG. 3 is a flowchart of a method that may be used with the system shown in FIG. 1 for allowing a player to play a primary game and secondary game via a user computing device, according to an embodiment of the invention.
Figure 4:
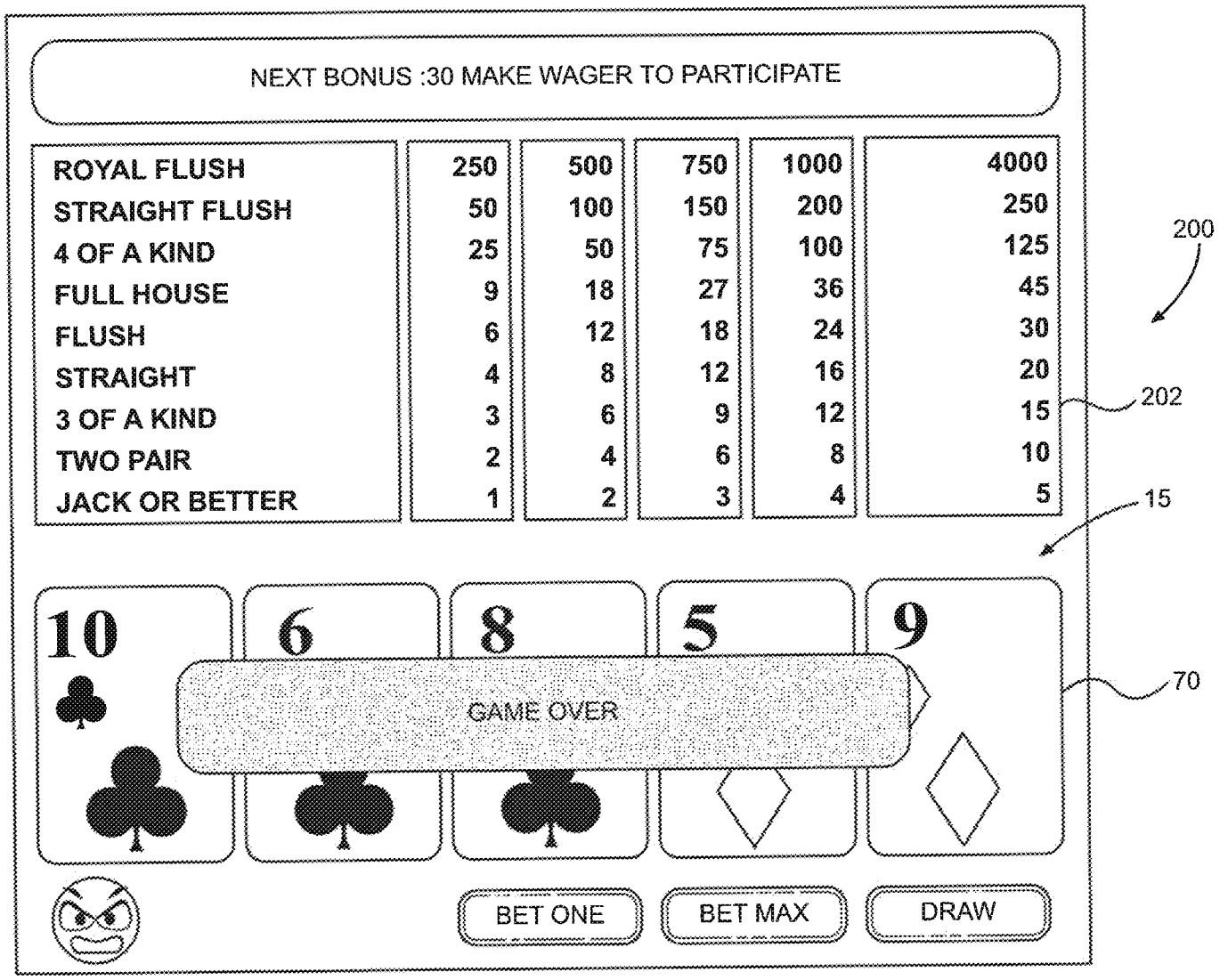
FIGS. 4-14 are exemplary graphical user interfaces or displays of a primary game and secondary contest that may be used with the method shown in FIG. 3, according to an embodiment of the present invention.
Figure 5:
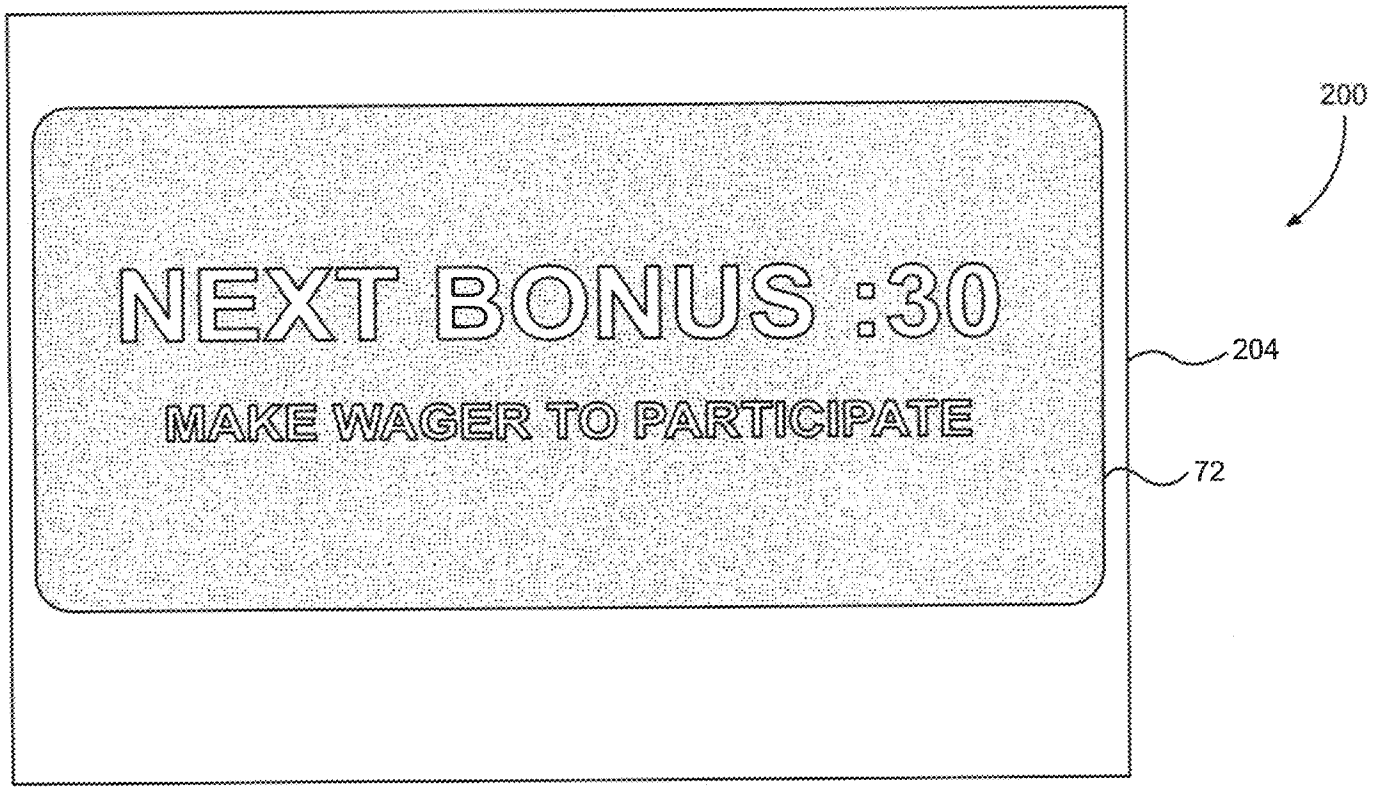
Figure 6:
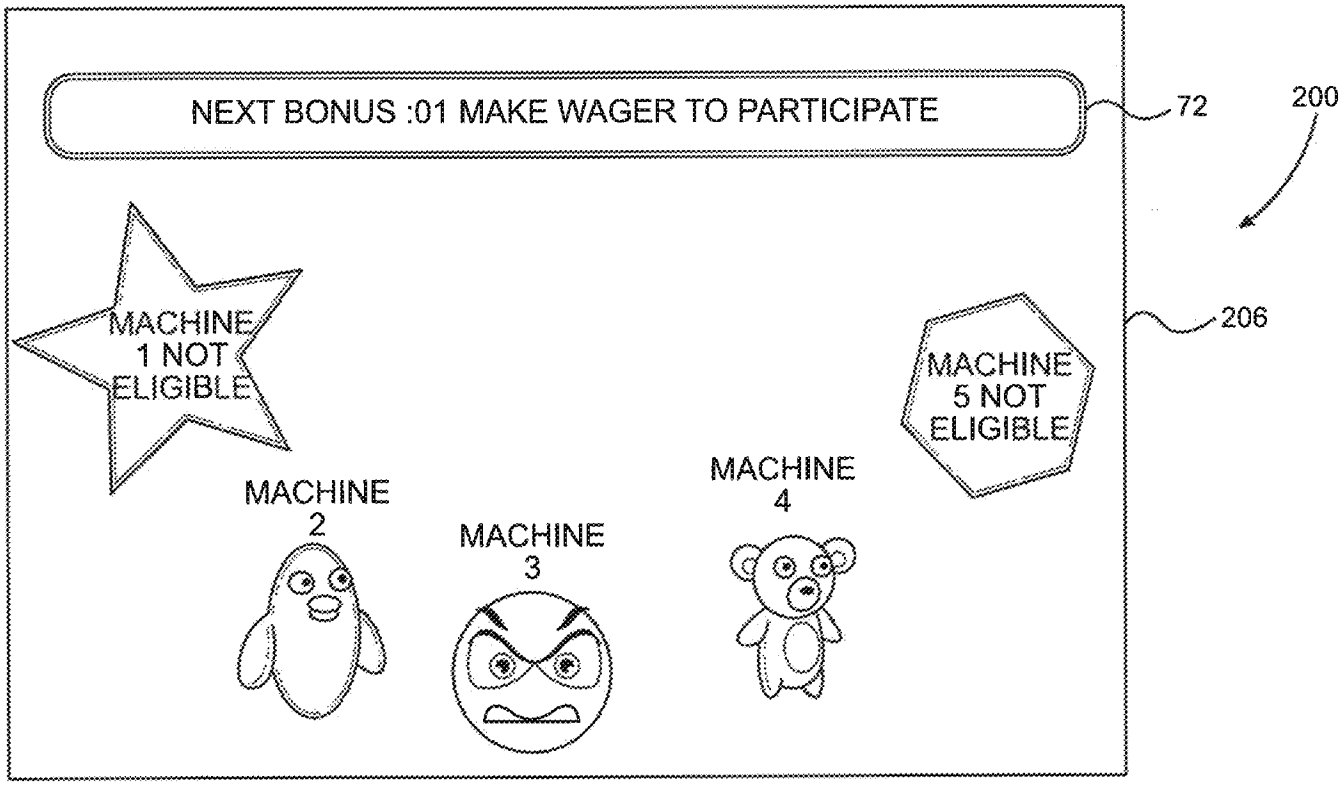
Figure 7:
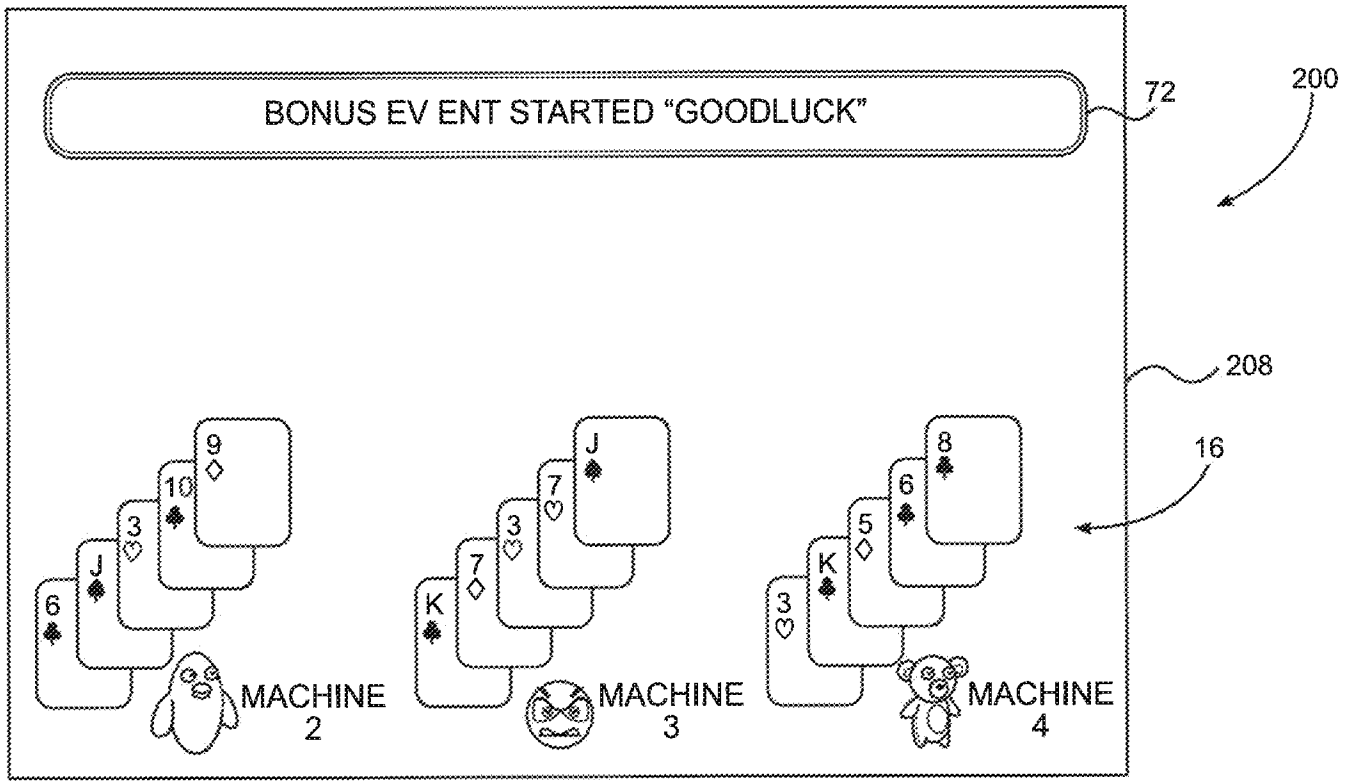
Figure 8:
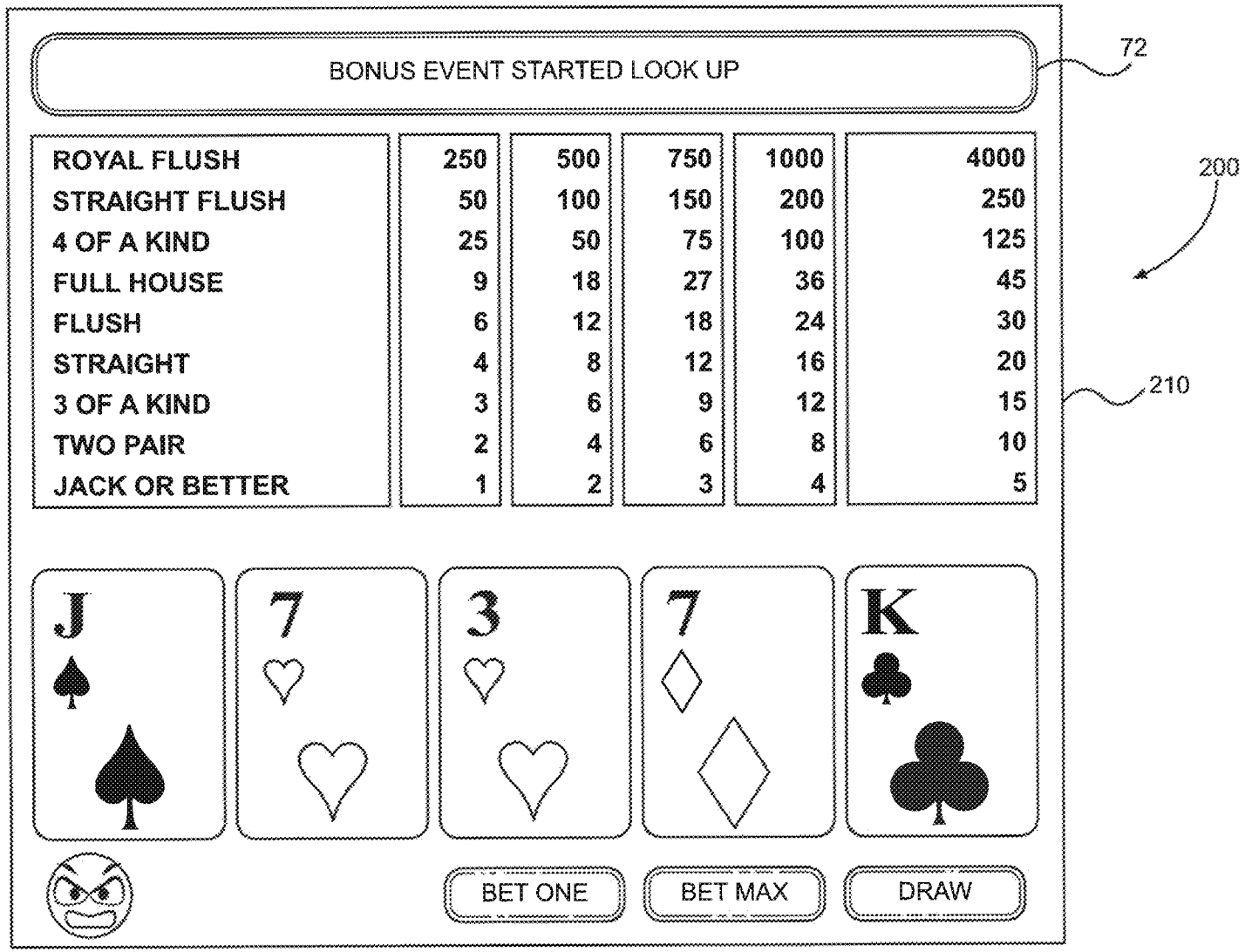
Figure 9:
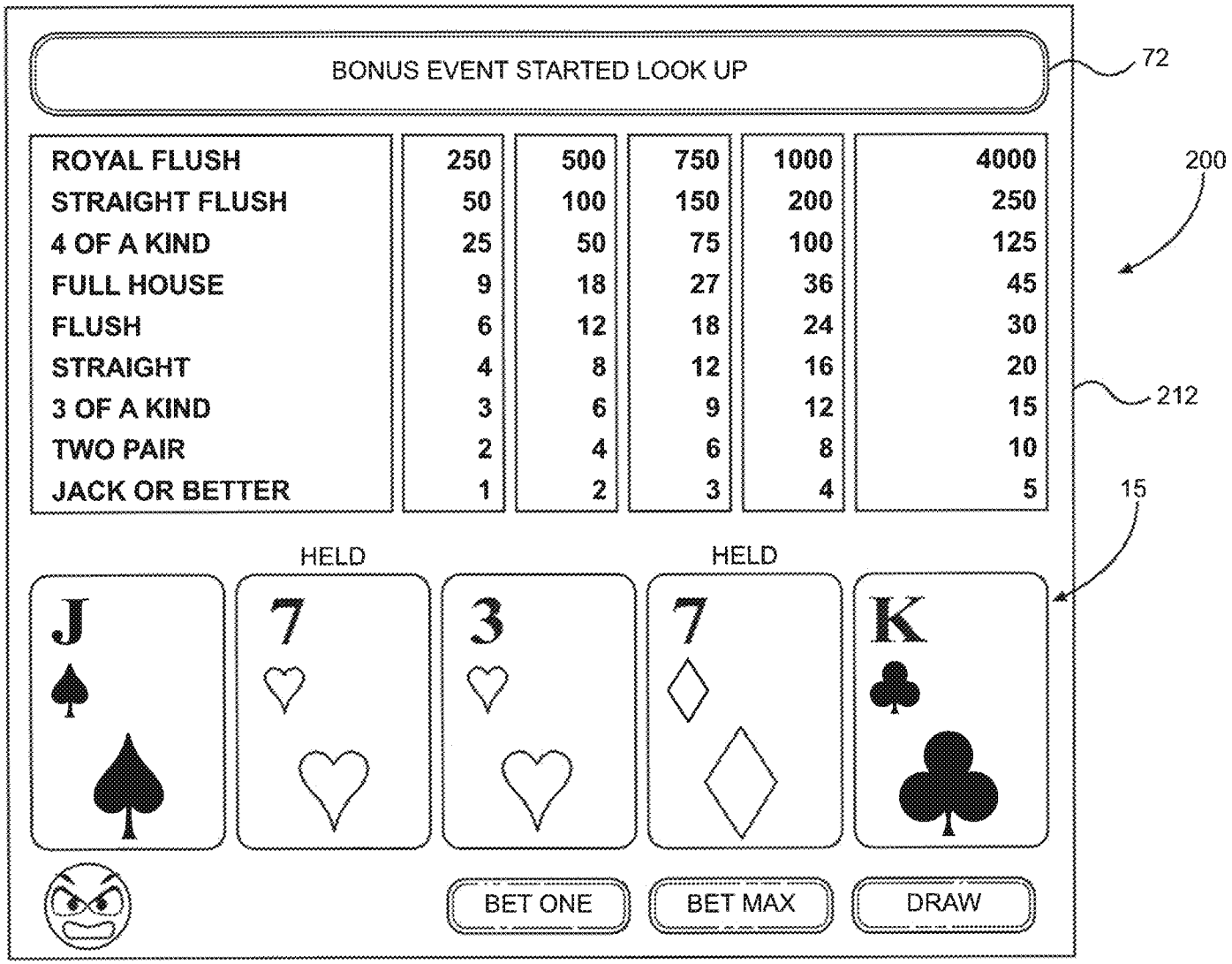
Figure 10:
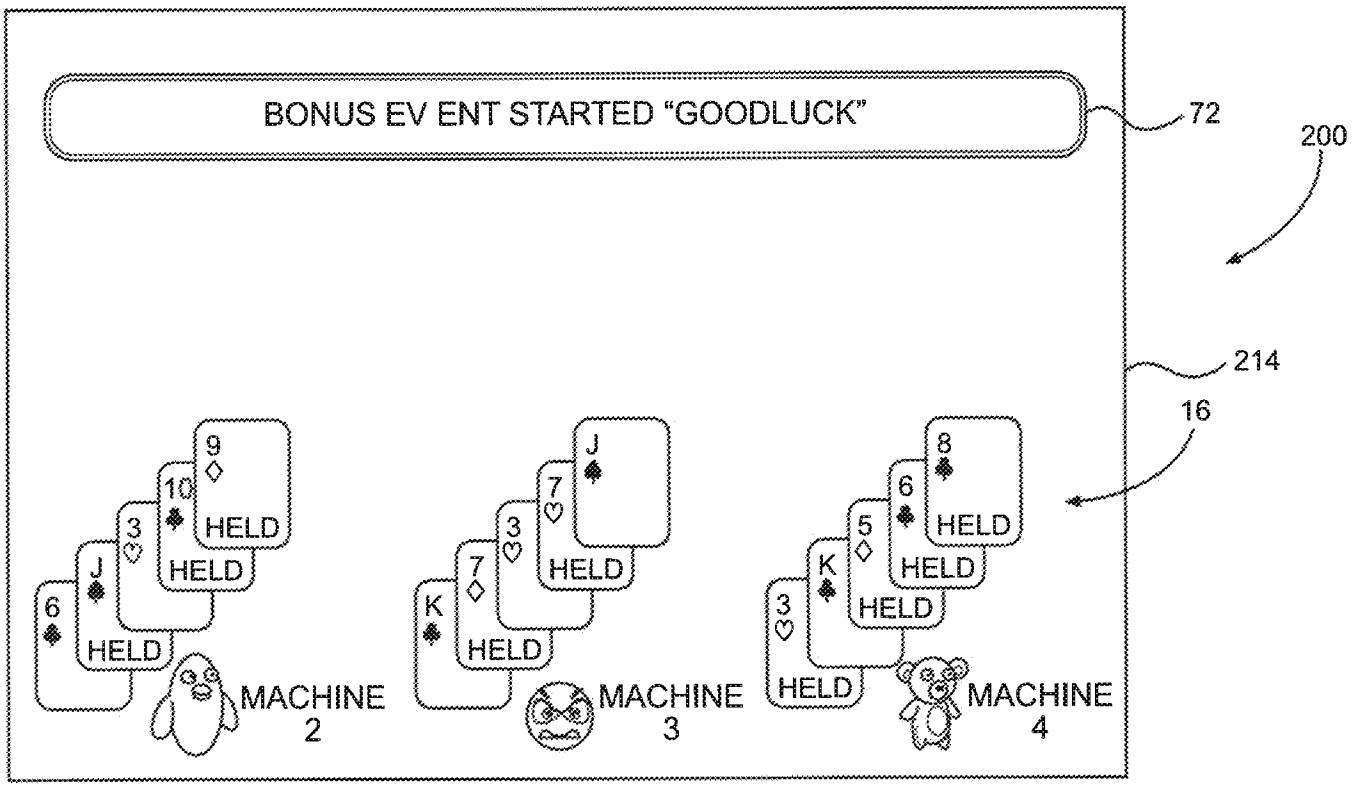
Figure 11:
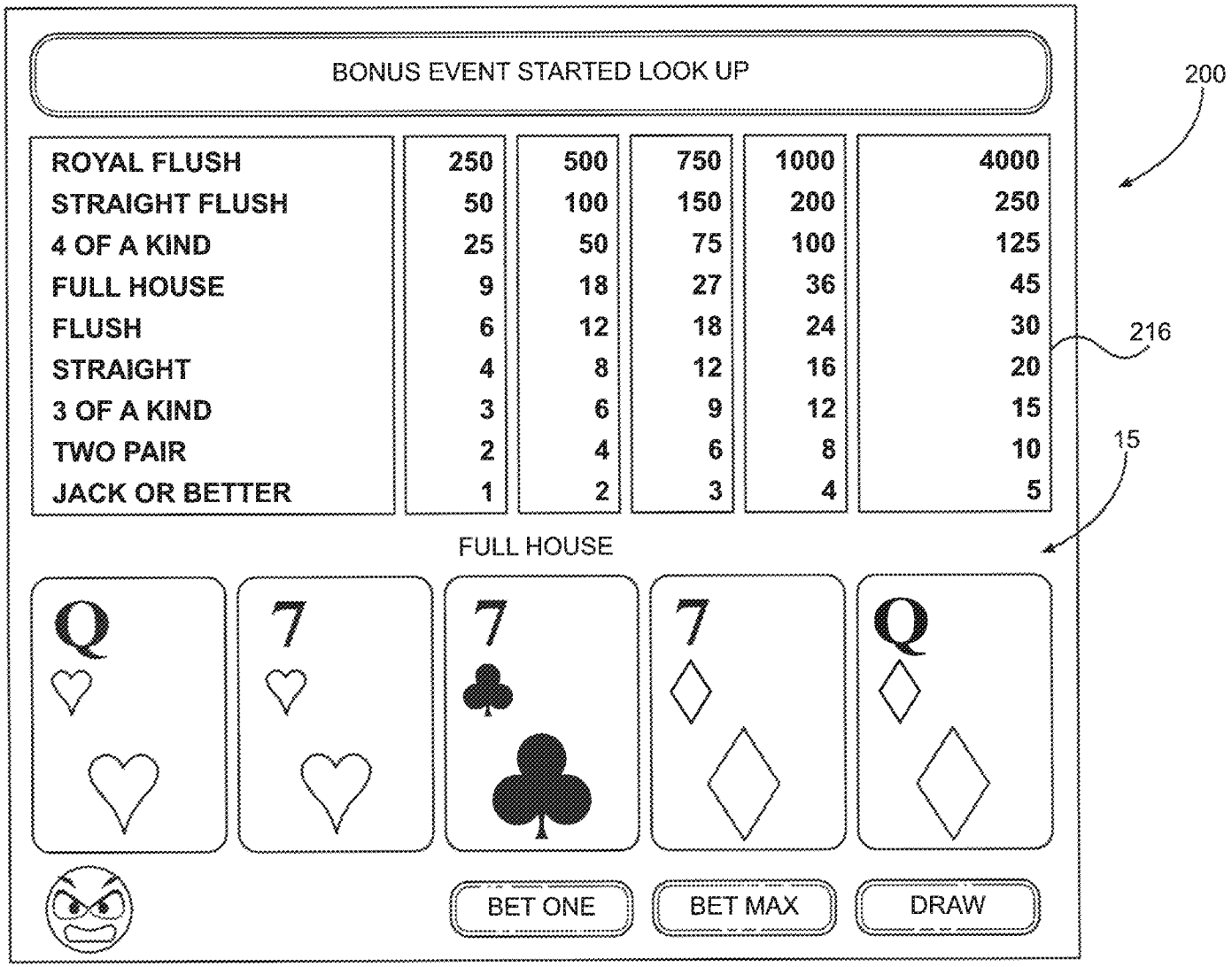
Figure 12:
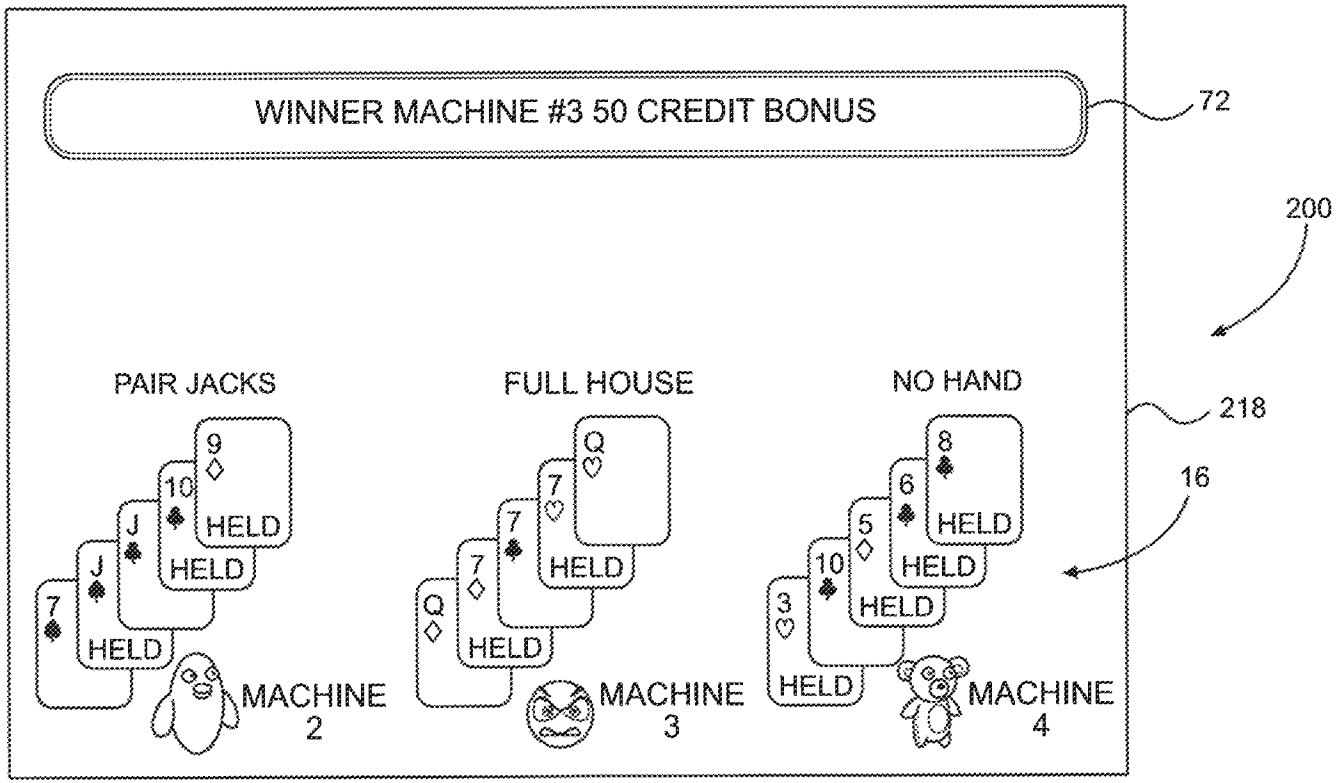
Figure 13:
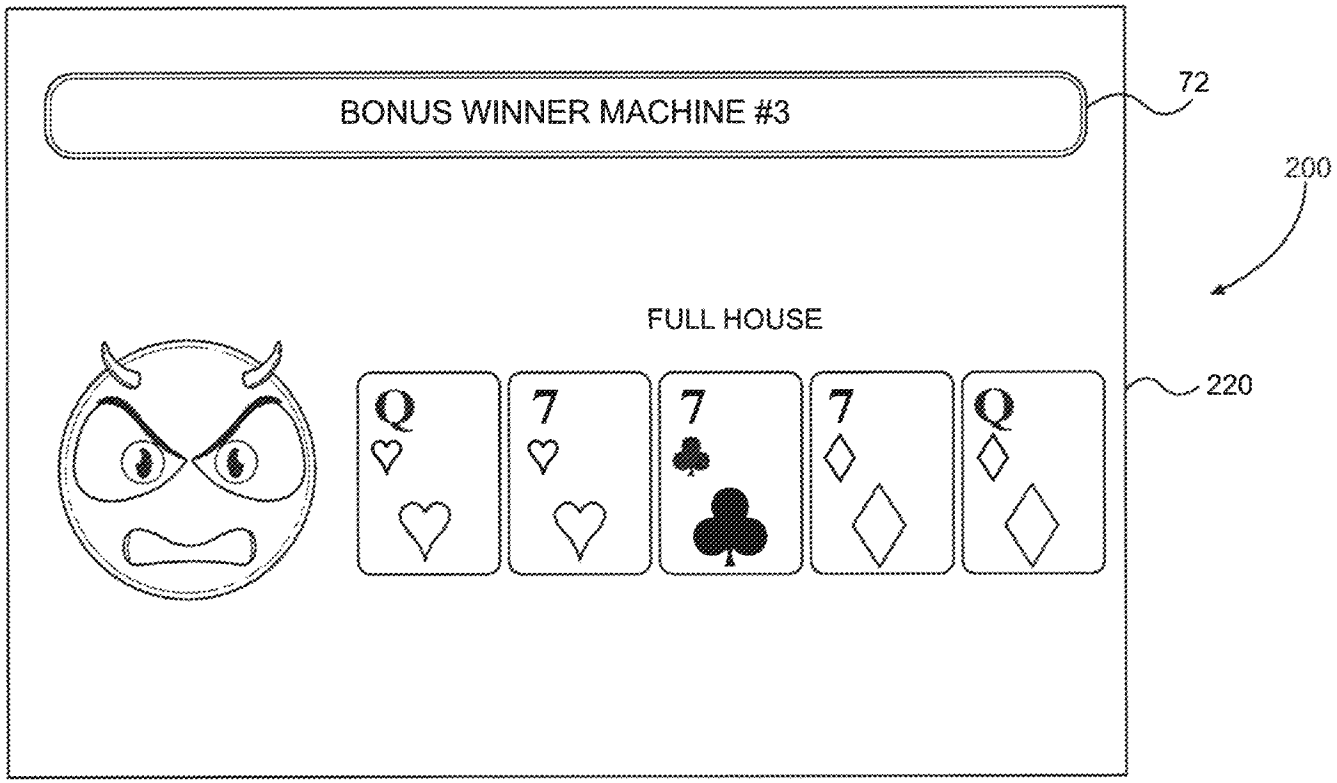
Figure 14:
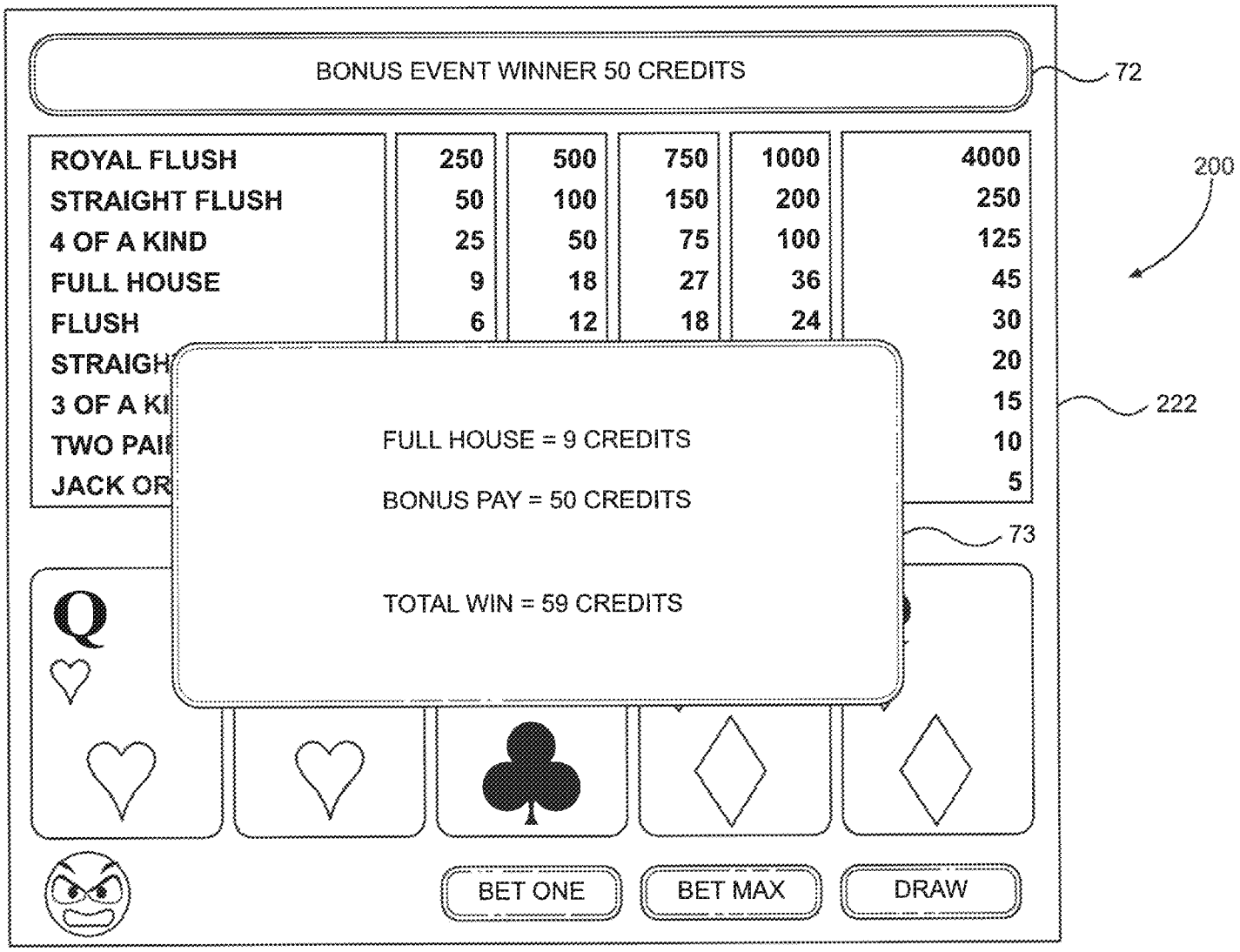

FIG. 3 is a flowchart of a method 100 that may be used with the system 10 for allowing a player to play a game via a user computing device 14. Each method step may be performed independently of, or in combination with, other method steps. Portions of the method 200 may be performed by any one of, or any combination of, the components of the system 10. Player selections involved in method 100 may be received via the user input device 34 of the user computing device 14 and may be transmitted by the user computing device 14 to the server system 12 via the network 22.

In the illustrated embodiment, in the method step 102, the gaming controller 36 transmits a query invitation on display device 32 to the user computing device 14 relating to placing a wager in the secondary contest 16. As discussed above, entering into the instance of the secondary contest 16 may be time-sensitive. If system 10 receives a wager in step 104, then it will be added to a pool of wagers in step 106 for the instance of the secondary contest 16. The primary game 15 is actuated and the game outcome data for each player in the secondary contest is compared in step 108. If there is a winner, such as the highest ranking poker hand amongst all players in the instance of the secondary contest 16, then the winning player is identified by system 10 and credited at their user computing device 14 with a payout award from the wager pool accordingly. If there is no winner, which may be the result of a tie or failure to satisfy some qualifying criteria, then in this embodiment, then one or more playoffs occur in which another primary game is actuated for each of the players and the results of the primary game are compared for purposes of resolving the secondary contest until a winner is determined.

In some embodiments, wagers are made from points or virtual currency achieved which may or may not be exchanged for real money, and awards may also be provided as virtual currency or real money, for the primary game and/or secondary contest. In some embodiments, no wager is required for the primary wagering game and a wager is required for the secondary contest only.

FIGS. 4-14 illustrate exemplary interfaces showing a primary game 15 of draw poker which may be provided on the display 200, which may comprise all or a portion of display 32 of any computing device 14. In this embodiment, display 200 is a touchscreen display, thus including data input capability. Interface 202 shows a draw poker session as having ended. In interface 204, a notification 72 is displayed on display 200 indicating that a "bonus," which is the name given to the secondary contest 16 in this embodiment, may be entered into by the player and a countdown timer of thirty seconds is displayed as part of notification 72.

In this embodiment, players may enter a wager to participate in an instance of the secondary contest 16 by touching the display 32 at the location of notification 72. Interface 206 shows the participants in the instance of the secondary contest 16 may be shown on display 32, which may be limited to include only those players involved locally or within certain regions. Interface 206, and other interfaces which provide secondary contest 16 details and results, such as interfaces 208, 214, 218, and 220, discussed further below, may be shown on a display 200 or a portion thereof, or alternatively on a separate display device. Interface 208 shows some initial results of game play occurring at computing devices 14, including the hands of cards dealt in the primary game 15 to each player in the secondary contest 16. For example, the computing device 14 identified as "machine 3" is shown as having been dealt a Jack of spades, Seven of hearts, Three of hearts, Seven of hearts and King of clubs. The display device 32 for this player may look as shown in interface 210. Interface 212 illustrates the player decision to hold the Sevens and discard the remaining cards in their hand in the primary wagering game 15. Interface 214 shows the decision making of some or all of the players in the secondary contest, including the decisions to hold the Sevens made by the player at machine 3. Interface 216 shows the results on the computing device 14 at machine 3 in the primary game 15, which reveals that the player was dealt a Seven of clubs, Queen of diamonds, and Queen of hearts to their hand, ranking as a full house in the primary wagering game 15. The game outcome data for the player at machine 3 therefore is a full house rank as shown in interface 218 compared with the game outcome data for others involved in this instance of the secondary contest 16, which is expressed as poker ranks, such as "pair of Jacks" for machine 2 and "no hand" for machine 4. Gaming controller 36 compares the hands and determines the winner, which may be displayed as shown in interface 220. Gaming controller 36 determines the award which may include all of the wagers placed in this instance of the secondary contest 16 minus a commission or rake, and displays the awards as credits in this embodiment as shown in interface 222. Interface 222 also shows the results of the primary wagering game 15 in the notification 73 and the total win based on the results of the primary wagering game and secondary contest, expressed as credits.

Figure 15:
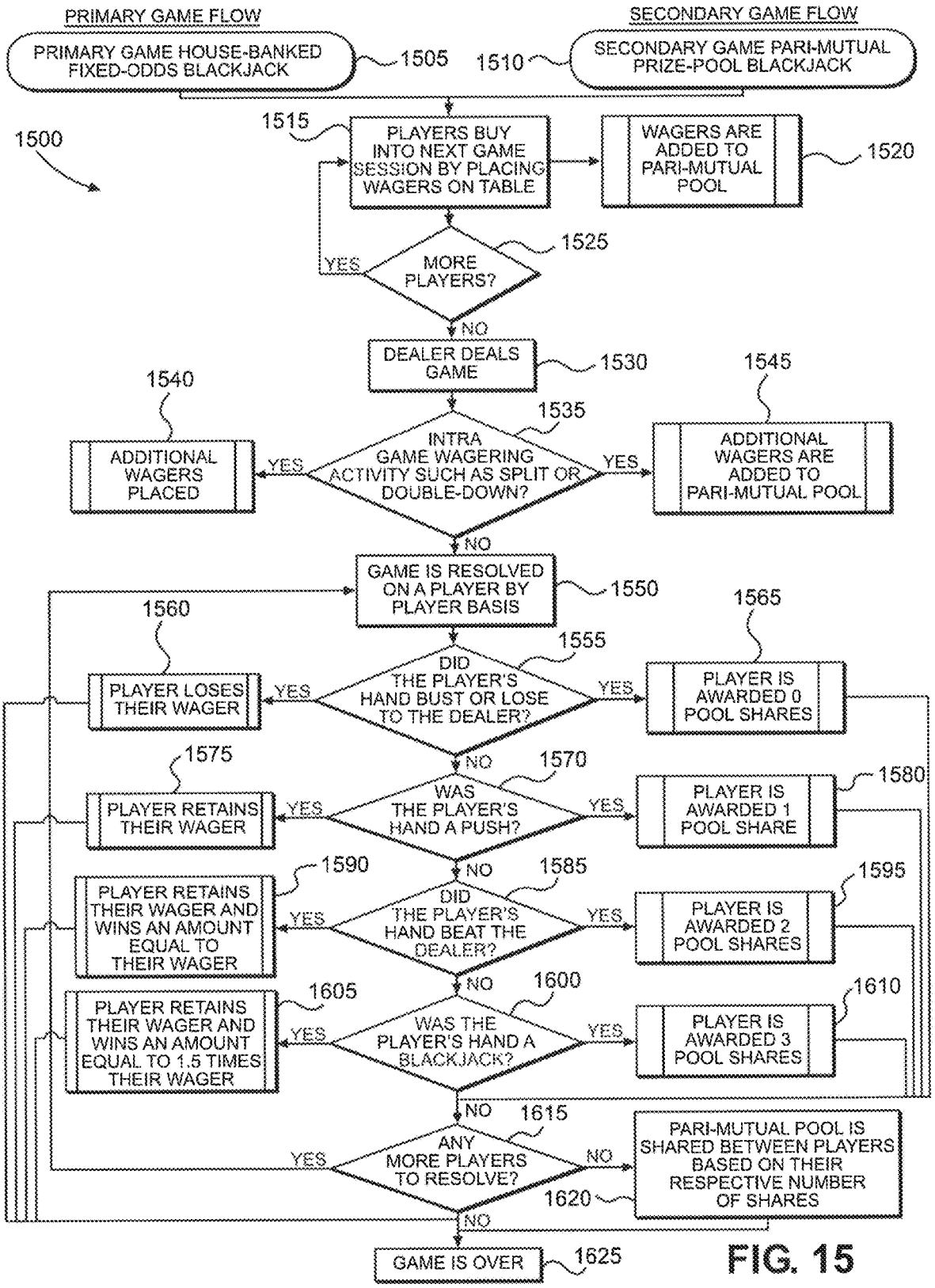
FIG. 15 is a flowchart of exemplary game flows in which the primary game is a traditional fixed-odds, house-banked Blackjack game and the secondary game is a pari-mutuel equivalent.

FIG. 15 is a flowchart representing a method for players participating in a primary traditional blackjack game where they play against the house for fixed odds in a house banked game. A secondary game is a pari-mutuel equivalent where players play against each other for shares of a pari-mutuel prize pool. As shown in flowchart 1500 of FIG. 15, a player elects to start play in either or both of a primary game flow 1505 and a secondary game flow 1510. For either or both, the player buys into the game session by placing wager(s) at step 1515. For pari-mutuel wagers on the secondary game, the wager amount is added to the pari-mutuel pool at step 1520. A waiting loop is then entered during which other players may enter the game at step 1525. As soon as all players have entered, or a time-out occurs, the cards are dealt at step 1530.

Play of the game continues with intra-game wagering activity such as splits and double down actions by the players at step 1535. For any such actions, wagers are placed at step 1540 and wagers are added to the pari-mutuel pool for wagers on the secondary game at step 1545. After completion of wager activity, the game play is completed at step 1550 by remaining cards being dealt and resolving game play for each player. It is determined whether a player busted or otherwise lost to the house at step 1555. If so, the player loses the wager in the primary game as reflected in step 1560, or is awarded 0 shares of the pari-mutuel pool for the secondary game at step 1565. If the player did not bust or lose to the house, it is determined whether the player achieved a push or tie with the house at step 1570. In the case of a tie with the house in the primary game, the player retains their wager at step 1575 while in the secondary game, the player is awarded 1 share of the pari-mutuel pool at step 1580.

If the player beats the house at step 1585 in the primary game, the player retains the original wager and wins an award that is typically amount equal to the wager at step 1590. If the player beats the house at step 1585 in the secondary game, the player is awarded 2 pari-mutuel shares at step 1595. Finally, it is determined whether the player achieved blackjack or 21 at step 1600. If so, the player retains the original wager and wins an amount that is typically equal to 1.5 times their wager for the primary game in step 1605. Or, the player is awarded 3 pool shares of the pari-mutuel pool for a secondary game blackjack or 21 in the secondary game at step 1610. Flowchart 1500 loops back to step 1550 to resolve each player independently at step 1615. Lastly, the amount of each share is determined for the pari-mutuel pool in the secondary game at step 1620 depending on the number of shares awarded during the payout process. The game ends at step 1625.

It should be understood that the player awards described for different wins is intended to be representative only. The actual payout for a win or a blackjack may be set as desired by the game developer or operator.

Figure 16:
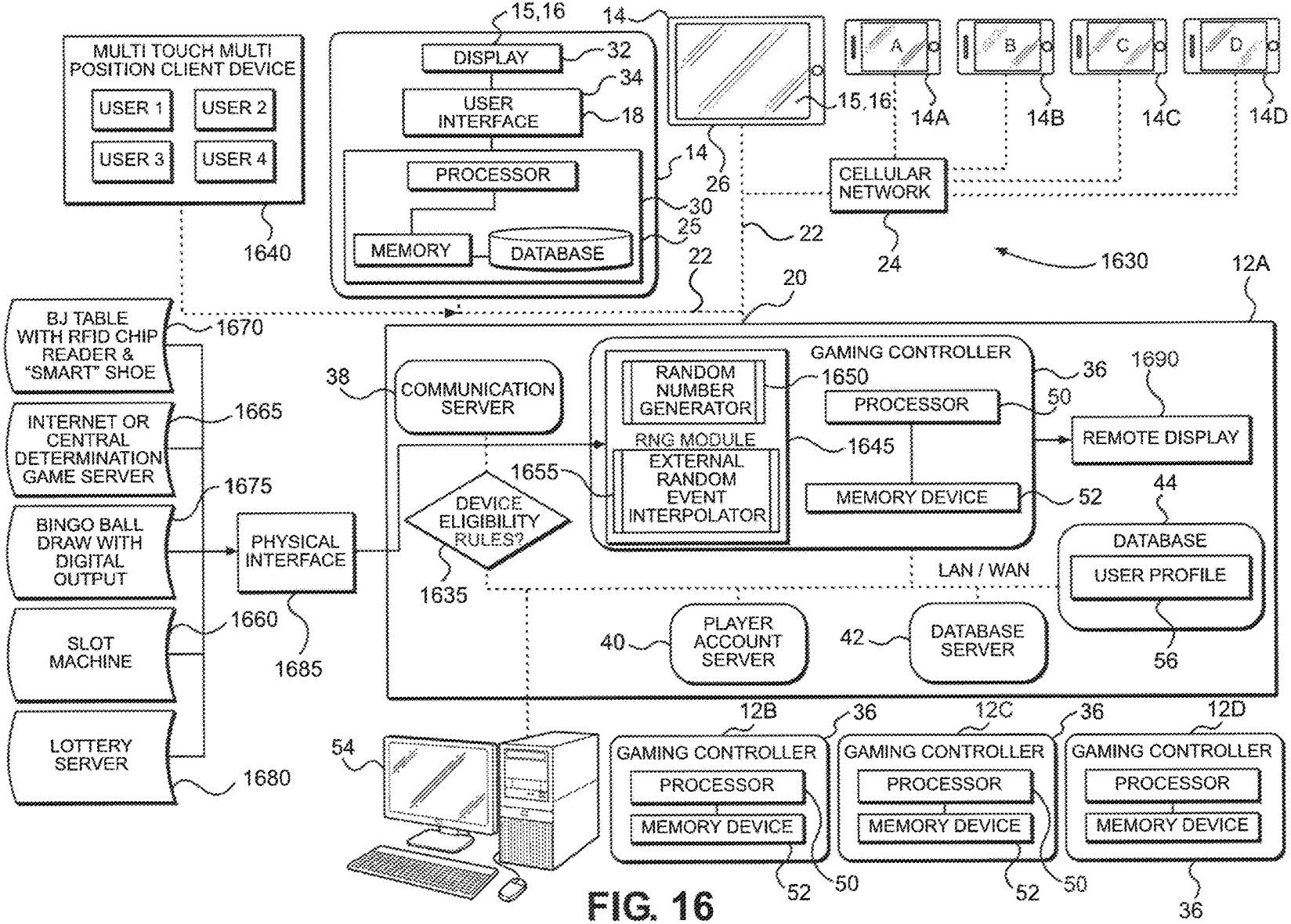
FIG. 16 is a schematic representation of an exemplary system for allowing a plurality of players to play a primary game on a plurality of game servers and a secondary contest via a plurality of user computing devices.

FIG. 16 is a schematic representation of an expanded system 1630 that is similar to system 10 of FIG. 1 with a number of additional components. In this expanded embodiment, system 1630 includes multiple gaming control servers 12*a-d*. Each gaming control server 12 has associated device eligibility rules 1635 in communication server 38 such that connectivity of user computing devices 14*a-d* with a plurality of corresponding gaming control servers 12*a-d* is governed by the corresponding communications server 38 based on a device eligibility rule set 1635. The rule set may, for example, include the user computing device location, game specific player quota criteria and/or other device eligibility criteria. A random number generator module 1645 in gaming control server 12 includes a random number generator (RNG) 1650 and an external random event interpolator 1655. RNG module 1645 outputs random event data to gaming controller 36 that is used by gaming controller 36 to provide game outcomes.

RNG module 1645 operates to produce random numbers using RNG 1650 or by interpolating random events input to external random event interpolator 1655. The external random events are produced and input to external random event interpolator 1655. Production of external random events may come from any number of different alternative sources including, but not limited to a slot machine or other electronic gaming device or machine (EGM) 1660, a networked central determination game server 1665, a blackjack table with RFID chip reader and a smart shoe 1670, a bingo ball draw or other physical randomizer device 1675 with a digital output, a lottery server 1680 or any other method or device configured to provide random or pseudo-random event results as are known in the art. Once the event occurs, it is input in electronic or digital form to a physical interface 1685 where relevant data is converted into a format compatible for interpolation by external random event interpolator 1655. Physical interface 1685 outputs a signal representing the random event to external random event interpolator 1655 of RNG module 1645.

In addition, a multi-touch, multi-position client device 1640 is shown. Multi-touch device 1640 represents a touch screen table or other electronic table or system that is configured to accommodate multiple players participating in primary games and secondary games, and playing simultaneously against each other and/or the house. A remote display 1690 is connected to gaming controller 36. Remote display 1690 is used to display secondary contest notifications to the gaming establishment patrons, the players and anyone else present who may or may not be participants in primary or secondary game contest activities.

Exemplary embodiments of a system and method of allowing a player to play and place wagers are described herein. It should be understood that there are a multitude of different combinations of wagering opportunities related to primary and secondary games. For example, the game play as depicted in flowchart 1500 of FIG. 15 allows a player to choose: (a) wagering in a primary game; (b) wagering in a secondary game; or (c) wagering in both a primary game and a secondary game at the same time. The primary and secondary games are described as blackjack games, but they may instead be poker games, bingo games, slot games or other game types.

In each different embodiment, a second game is offered in which the outcome is determined by the outcome data of a first game. The system and method are not limited to the specific embodiments described herein, but rather, components of the system and/or steps of the method may be utilized independently and separately from other components and/or steps described herein. For example, the system may also be used in combination with other wagering systems and methods, and is not limited to practice with only the system as described herein. Rather, an exemplary embodiment can be implemented and utilized in connection with many other wagering applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. The terms used herein, such as modules like display module, betting module, award module, servers, like player account server, database server, etc. are for ease in describing and illustrating features and operations of the invention and are not to be considered limiting in any way. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle™ Database, MySQL, IBM™ DB2, Microsoft™ SQL Server, Sybase™, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system or incorporated in an existing gaming system. The system of the invention may include various computer and network related software and hardware, such as programs, operating systems, memory storage devices, data input/output devices, data processors, servers with links to data communication systems, wireless or otherwise, and data transceiving terminals. It should also be understood that any method steps discussed herein, such as for example, steps involving the receiving or displaying of data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto, either through a mobile device, gaming platform, or other computing platform via a local network or global telecommunication network.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A system comprising:

a gaming controller configured to initiate an instance of a primary game to a plurality of players, the primary game being a house-banked fixed odds game and having a primary game result, the primary game result being randomly determined;

at least one user controller for each of the players in communication with the gaming controller to participate in the primary game;

the gaming controller being configured to receive game information related to the primary game result of the instance of the primary game and responsively facilitating a secondary game, wherein the secondary game includes a competition between the players competing in the instance of the primary game, the outcome of the secondary game being determined as a function of the primary game result, the gaming controller being further configured to:

allow each of the players to elect to start play in at least one of the primary game and secondary game;

allow each of the players to place a primary wager;

allow each of the players to place a secondary wager, wherein at least a portion of each secondary wager is added to a prize pool;

complete play of the primary game and resolve game play for each of the players; and, allot each of the players a portion of the prize pool as a function of the outcome of the primary game, wherein the portion awarded to each of the players is selected from a set of possible portions, wherein each of the players is awarded the portion of the prize pool equal to a predetermined ratio, wherein the prize pool is awarded after each instance of the primary game if any of the players competing in the instance of the primary game have been awarded any portions and the prize pool is held for a next instance of the primary game if none of the players competing in the instance of the primary game have been awarded any portions.

2. A system, as set forth in claim 1, wherein the gaming controller is configured to randomly establish the outcome of the primary game as a function of a random number generator (RNG).

3. A system, as set forth in claim 1, wherein the user controller is implemented, at least in part, by a user computing device.

4. A system, as set forth in claim 3, wherein each user computing device is associated with a player and including an input device, the user input device being configured to allow the associated player to input data related to the primary game.

5. A system, as set forth in claim 4, wherein each computing device includes a display configured to display text and/or graphical data to the associated player.

6. A system, as set forth in claim 1, wherein the gaming controller is implemented, as least in part, by a server.

7. A system, as set forth in claim 1, wherein the gaming controller, in facilitating the secondary game, is further configured to compare the primary game result with a preset criteria to determine a winning or non-winning outcome of the secondary game.

8. A system, as set forth in claim 7, wherein the preset criteria includes at least one of the following: rank achieved, credits won over one or more instances of the primary game, primary game score, appearance of predetermined symbols or patterns within the primary game, achieving certain winning or losing primary game results, predetermined number of winning or losing outcomes in the primary game, reaching a threshold after tracking players, and reaching a threshold based on credits earned or games played.

9. A system, as set forth in claim 1, wherein the gaming controller is configured to determine a winning or non-winning outcome of the secondary game for each player in the secondary contest.

10. A system, as set forth in claim 1, wherein the primary game is a card game using physical cards, the primary game result being determined by cards dealt by the dealer.

11. A system, as set forth in claim 1, further comprising a RFID chip reader and a smart shoe coupled to the gaming controller, the gaming controller being configured to establish the primary game result as a function of data received from the RFID chip reader and the smart shoe.

12. A method comprising the steps of:

providing, by a gaming controller, a primary game to a plurality of players, each of the players using at least one user controller to participate in the primary game;

initiating, by the gaming controller, an instance of the primary game, the primary game being a house-banked fixed odds game and having a primary game result, the primary game result being randomly determined; and receiving, at the gaming controller, game information related to the primary game result of the instance of the primary game and responsively facilitating a secondary game, wherein the secondary game includes a competition between the players competing in the instance of the primary game, the outcome of the secondary game being determined as a function of the primary game result, the method further including the steps of:

allowing each of the players to elect to start play in at least one of the primary game and secondary game;

allowing each of the players to place a primary wager;

allowing each of the players to make a secondary wager, wherein at least a portion of each secondary wager is added to a prize pool;

completing play of the primary game and resolving game play for each of the players; and, allotting each of the players a portion of the prize pool as a function of the outcome of the primary game, wherein the portion awarded to each of the players is selected from a set of possible portions, wherein each of the players is awarded the portion of the prize pool equal to a predetermined ratio, wherein the prize pool is awarded after each instance of the primary game if any of the players competing in the instance of the primary game have been awarded any portions and the prize pool is held for a next instance of the primary game if none of the players competing in the instance of the primary game have been awarded any portions.

13. A method, as set forth in claim 12, including the step of randomly establishing, by the gaming controller, the outcome of the primary game as a function of a random number generator (RNG).

14. A method, as set forth in claim 12, including the step of comparing, by the gaming controller, the primary game result with a preset criteria to determine a winning or non-winning outcome of the secondary game.

15. A method, as set forth in claim 14, wherein the preset criteria includes at least one of the following: rank achieved, credits won over one or more instances of the primary game, primary game score, appearance of predetermined symbols or patterns within the primary game, achieving certain winning or losing primary game results, predetermined number of winning or losing outcomes in the primary game, reaching a threshold after tracking players, and reaching a threshold based on credits earned or games played.

16. A method, as set forth in claim 12, including the step of determining, by the gaming controller, a winning or non-winning outcome of the secondary game for each player in the secondary contest.

17. A method, as set forth in claim 12, wherein each player pays a primary wager to play the primary game and the gaming controller may award a primary game award to one or more players based on the primary game result, the player's primary wager and a predetermined paytable.

18. A method, as set forth in claim 12, wherein each player must pay the secondary wager to enter the secondary game.

19. A method, as set forth in claim 12, wherein the primary game is a card game using physical cards, the primary game result being determined by cards dealt by a dealer.

20. A method, as set forth in claim 12, including the step of further establishing the primary game result as a function of data received from an RFID chip reader and a smart shoe.

* * * * *